US011709008B2

(12) United States Patent
Naik et al.

(10) Patent No.: US 11,709,008 B2
(45) Date of Patent: Jul. 25, 2023

(54) REFRIGERATOR WITH MULTI-ZONE ICE MAKER

(71) Applicant: Midea Group Co., Ltd., Foshan (CN)

(72) Inventors: Vinayak Naik, Louisville, KY (US); Mark W. Wilson, Simpsonville, KY (US); Eric Scalf, Louisville, KY (US)

(73) Assignee: MIDEA GROUP CO., LTD., Foshan (CN)

( * ) Notice: Subject to any disclaimer, the term of this patent is extended or adjusted under 35 U.S.C. 154(b) by 59 days.

(21) Appl. No.: 17/039,701

(22) Filed: Sep. 30, 2020

(65) Prior Publication Data

US 2022/0099349 A1 Mar. 31, 2022

(51) Int. Cl.
*F25C 5/08* (2006.01)

(52) U.S. Cl.
CPC ..... *F25C 5/08* (2013.01); *F25C 2600/04* (2013.01)

(58) Field of Classification Search
CPC ... F25C 5/08; F25C 2600/04; F25C 2305/024
See application file for complete search history.

(56) References Cited

U.S. PATENT DOCUMENTS 2,035,679 A 3/1936 Thompson
2,433,210 A 12/1947 Gits
3,214,128 A 10/1965 Beck
3,393,531 A * 7/1968 Parr ..... F25C 1/04 62/356
3,581,516 A 6/1971 Buchser et al.
3,864,933 A 2/1975 Bright
3,952,539 A 4/1976 Hanson et al.
4,942,742 A 7/1990 Burruel
5,056,321 A 10/1991 Patrick
5,408,844 A * 4/1995 Stokes ..... F25C 5/08 249/79
5,582,754 A 12/1996 Smith et al.
5,992,167 A 11/1999 Hill et al.
6,308,518 B1 10/2001 Hunter
(Continued)

FOREIGN PATENT DOCUMENTS

KR 2006098052 A * 9/2006

OTHER PUBLICATIONS

Translated_KR-2006098052-A (Year: 2006).*
(Continued)

*Primary Examiner* — Elizabeth J Martin
*Assistant Examiner* — Samba Gaye
(74) *Attorney, Agent, or Firm* — Gray Ice Higdon

(57) ABSTRACT

A refrigerator includes a cabinet with one or more food compartments and one or more doors closing the food compartments and an ice maker located in the cabinet to produce ice. The ice maker includes a mold body for forming ice, the mold body having multiple cups, where each cup has an opening for receiving water to be frozen within the cup. The mold body is divided into at least a first zone and a second zone and the ice maker including at least a first heater and a second heater configured to provide heat to the first and second zones of the mold body, respectively, and a controller configured to harvest ice from the first zone independently of the second zone by actuating the first heater to provide heat to the first zone of the mold body to facilitate a release of ice from the first zone.

20 Claims, 7 Drawing Sheets

(56) References Cited

U.S. PATENT DOCUMENTS

| | | | | |
|---|---|---|---|---|
| 6,951,113 | B1 | 10/2005 | Adamski | |
| 7,143,588 | B2 | 12/2006 | Cole | |
| 7,629,558 | B2 | 12/2009 | Petrenko | |
| 8,099,975 | B2 | 1/2012 | Rafalovich et al. | |
| 8,371,133 | B2 | 2/2013 | Kim et al. | |
| 9,012,811 | B2 | 4/2015 | White | |
| 9,746,229 | B2 | 8/2017 | Visin et al. | |
| 10,598,420 | B2 | 3/2020 | Woo et al. | |
| 11,105,547 | B2 | 8/2021 | Song et al. | |
| 11,112,160 | B2 | 9/2021 | Hong et al. | |
| 2003/0155467 | A1 | 8/2003 | Petrenko | |
| 2007/0101753 | A1 | 5/2007 | Broadbent | |
| 2009/0025401 | A1 | 1/2009 | Heger et al. | |
| 2009/0165492 | A1* | 7/2009 | Wilson | F25C 1/10 62/344 |
| 2009/0211267 | A1 | 8/2009 | Kim et al. | |
| 2009/0223230 | A1 | 9/2009 | Kim et al. | |
| 2012/0318003 | A1 | 12/2012 | Kim et al. | |
| 2013/0239594 | A1 | 9/2013 | Lin et al. | |
| 2016/0201965 | A1 | 7/2016 | Abeygunawardana | |
| 2017/0307278 | A1 | 10/2017 | Chandran et al. | |
| 2019/0011167 | A1* | 1/2019 | Larson | F25C 5/08 |
| 2019/0226750 | A1 | 7/2019 | Kang et al. | |
| 2020/0064043 | A1 | 2/2020 | Larson et al. | |
| 2020/0158408 | A1 | 5/2020 | Kim et al. | |
| 2020/0158410 | A1 | 5/2020 | Kim et al. | |
| 2020/0400359 | A1 | 12/2020 | Junge et al. | |
| 2021/0080165 | A1 | 3/2021 | Bertolini et al. | |
| 2021/0325100 | A1* | 10/2021 | Smith | F25C 1/04 |

OTHER PUBLICATIONS

Transmittal of Related Applications dated Jun. 3, 2022.
U.S. Appl. No. 17/039,701, filed Sep. 30, 2020.
U.S. Appl. No. 17/717,793, filed Apr. 11, 2022.
United States Patent and Trademaark Office; Non-Final Office Action issued in U.S. Appl. No. 17/717,793, 45 pages, dated Mar. 17, 2023.

* cited by examiner

REFRIGERATOR WITH MULTI-ZONE ICE MAKER

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments.

Irrespective of the refrigerator design employed, many refrigerator designs also include an ice making and dispensing system. Ice makers typically include an aluminum mold body with ice trays, where water may be shaped and frozen. Once the water is frozen in the trays, a heater may be used to melt the surfaces of the ice in contact with the trays to facilitate release of the ice from the trays, e.g., using a rake or by inverting the mold body. Generally, ice makers include a metallic calrod heater disposed within the aluminum mold body to melt the surfaces of the ice. A calrod heater is generally not in direct contact with the ice trays, but rather the calrod heater may be positioned in a lower portion of the mold body. The heat generated by the calrod heater then travels through the mold body to warm the ice trays in order to release the ice.

These ice making systems may also contain excess material not directly related to making ice, but rather for the retention of heat and thermal conductivity; this excess material may take valuable storage space away from the compartments of the refrigerator. Additionally, these calrod heaters are on anytime they are energized, and as such, they cannot be precisely controlled. They may also require a lengthy warm up and/or cool down period. As such, there exists a need in the art for ice makers that may be able to more precisely control the heating and harvesting of ice.

SUMMARY

The herein-described embodiments address these and other problems associated with the art by providing a refrigerator that utilizes an ice maker with multiple zones for generating and harvesting of ice. Doing so may enable, for example, the harvest of ice from individual zones of the ice maker, rather than the entire tray of ice.

Therefore, consistent with one aspect of the invention, a refrigerator may include a cabinet including one or more food compartments and one or more doors closing the one or more food compartments, an ice maker located in the cabinet for producing ice, the ice maker including: a mold body for forming ice, the mold body including a plurality of cups, each cup having an opening for receiving water to be frozen within the cup, where the mold body is divided into at least a first zone and a second zone; at least a first heater and a second heater to provide heat to the first and second zones of the mold body and facilitate a release of ice from the first and second zones of the mold body, respectively; a controller coupled to the ice maker and to harvest ice from the first zone independently of the second zone by actuating the first heater to provide heat to the first zone of the mold body to facilitate a release of ice from the first zone and thereafter harvesting ice from the second zone once the ice in the first zone is released from the first zone.

In some embodiments, each cup of the plurality of cups is constructed of metal and the mold body is constructed of plastic. In other embodiments, each cup of the plurality of cups is constructed of a plastic material with a metallic coating. In still other embodiments, each cup of the plurality of cups is individually removable from the mold body.

In some embodiments, the first and second zones are among a plurality of zones and the first and second heaters are among a plurality of heaters, and where each cup of the plurality of cups defines a zone among the plurality of zones and has an associated heater among the plurality of heaters. In some such embodiments, the controller is further configured to independently control each heater among the plurality of heaters. In some embodiments, each cup of the plurality of cups has a non-uniform thickness. In such embodiments, each cup of the plurality of cups is thickest at a portion proximate the corresponding heater among the plurality of heaters.

In some embodiments, the first and second zones of the mold body further include a first temperature senor and a second temperature sensor, respectively. In some such embodiments, the controller is further configured to: receive a first and second signal from the first and second temperature sensors, respectively; determine, based on the first signal and second signal, if the first or second zone is within a predefined temperature range; and actuate the first heater or the second heater to begin heating each cup of the plurality of cups within the first or second mold body.

In some embodiments, the controller is further configured to stagger the harvest of ice, where only the first zone of the mold body or the second zone of the mold body is harvested, while the other of the first zone of the mold body or the second zone of the mold body remains unharvested. In some such embodiments, the ice maker further includes: a reversible motor to harvest ice; a plurality of rake fingers, wherein a first portion of the plurality of rake fingers rotate in a clockwise direction and a second portion of the plurality of rake fingers rotate in a counter-clockwise direction; and where the reversible motor drives the clockwise rotation of the first portion of the plurality of rake fingers to harvest the first zone of the mold body; and where the reversible motor drives the counter-clockwise rotation of the second portion of the plurality of rake fingers to harvest the second zone of the mold body.

In some embodiments, the ice maker further includes: motor to harvest ice; a plurality of rake fingers, including: a first portion of the plurality of rake fingers located in the first zone and in a first position; and a second portion of the plurality of rake fingers located in the second zone and in a second, differing position. In some embodiments, the first position and the second position are directly opposed to each other. In other embodiments, the ice maker further includes: a motor to harvest ice; plurality of rake fingers, where each rake finger of the plurality of rake fingers is in a different position to allow for a staggered rake of a single piece of ice at a time.

In some embodiments, each cup among the plurality of cups located in the first zone of the mold body is a first shape, and each cup among the plurality of cups located in the second zone of the mold body is a second, different shape.

In some embodiments, the first heater and the second heater are ceramic heaters.

In some embodiments, the controller is further configured to: determine if the ice in a first or second zone is at a predefined level of solidity; actuate the first heater or the second heater to begin heating each cup of the plurality of cups within the first or second mold body zone prior to the ice being completely solid.

In another aspect, an ice maker includes: a mold body for forming ice, the mold body including a plurality of cups, each cup having an opening for receiving water to be frozen within the cup, where the mold body is divided into at least a first zone and a second zone; at least a first heater and a second heater to provide heat to the first and second zones of the mold body and thereby facilitate a release of ice from the first and second zones of the mold body, respectively; a controller coupled to the ice maker and to harvest ice from the first zone independently of the second zone by actuating the first heater to provide heat to the first zone of the mold body to facilitate a release of ice from the first zone and thereafter harvesting ice from the second zone once the ice in the first zone is released from the first zone.

In yet another embodiment, a refrigerator, includes: a cabinet including one or more food compartments and one or more doors closing the one or more food compartments; an ice maker located in the cabinet to produce ice, the ice maker including: a mold body divided into at least a first zone and a second zone; a plurality of cups located within the mold body, where each cup of the plurality of cups further includes: a heater located proximate the cup and thereby facilitate a release of ice from the cup; and an opening for receiving water to be frozen within the cup; at least a first temperature sensor located in the first zone of the mold body and a second temperature sensor located in the second zone of the mold body; and a controller coupled to the ice maker and configured to: independently control, based on a signal from the first or second temperature sensor, the heater of each cup of the plurality of cups; determine, based on the signal from the first or second temperature signal, if ice is ready to be harvested from the first or second zone of the mold body; and harvest ice from the first or the second zone of the mold body.

In some embodiments, each cup of the plurality of cups is removable from the mold body and constructed of metal, and wherein the mold body is constructed of plastic. In other embodiments, each cup of the plurality of cups is constructed on a plastic material with a metallic coating. In still other embodiments, each cup of the plurality of cups has a non-uniform thickness and the thickest portion of the cup is proximate the heater.

In some embodiments, the controller is further configured to stagger the harvest of ice, where only the first zone of the mold body or the second zone of the mold body is harvested, while the other of the first zone of the mold body or the second zone of the mold body remains unharvested. In some such embodiments, the ice maker further comprises: a reversible motor to harvest ice; a plurality of rake fingers, where a first portion of the plurality of rake fingers rotate in a clockwise direction and a second portion of the plurality of rake fingers rotate in a counter-clockwise direction; and where the reversible motor drives the clockwise rotation of the first portion of the plurality of rake fingers to harvest the first zone of the mold body; and where the reversible motor drives the counter-clockwise rotation of the second portion of the plurality of rake fingers to harvest the second zone of the mold body.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
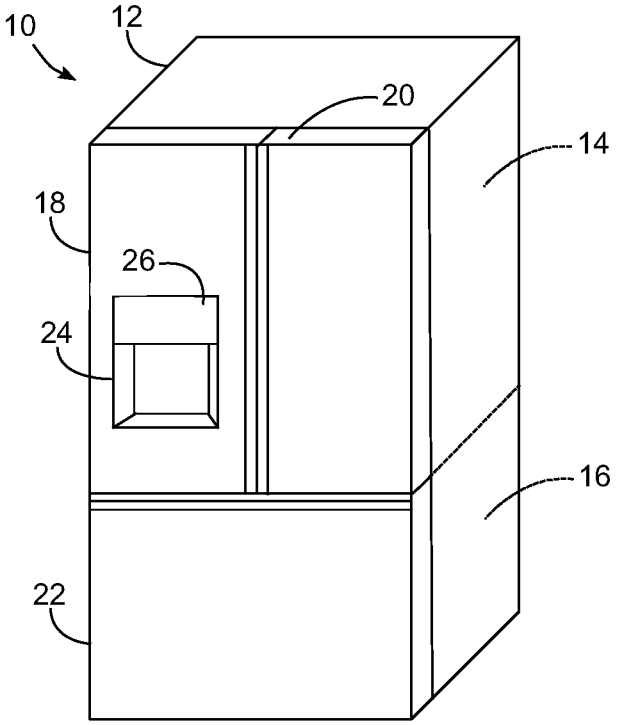
FIG. 1 is a perspective view of an example implementation of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18, 20 and one or more freezer compartment doors 22 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc.

Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a single sliding freezer compartment door 22 that is similar to a drawer and that pulls out to provide access to items in the freezer compartment. It will be appreciated, however, that other door designs may be used in other embodiments, including various combinations and numbers of hinged and/or sliding doors for each of the fresh food and freezer compartments. Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments.

Refrigerator 10 also includes a door-mounted dispenser 24 for dispensing ice and/or a fluid such as water. In the illustrated embodiments, dispenser 24 is an ice and water dispenser capable of dispensing both ice (cubed and/or crushed) and chilled water, while in other embodiments, dispenser 24 may be an ice only dispenser for dispensing only cubed and/or crushed ice. In still other embodiments, dispenser 24 may dispense hot water, coffee, beverages, or other fluids, and may have variable and/or fast dispense capabilities, as well as an ability to dispense predetermined or measured quantities of fluids. In some instances, ice and water may be dispensed from the same location, while in other instances separate locations may be provided in the dispenser for dispensing ice and water.

Refrigerator 10 also includes a control panel 26, which in the illustrated embodiment is integrated with dispenser 24 on door 18, and which includes various input/output controls such as buttons, indicator lights, alphanumeric displays, dot matrix displays, touch-sensitive displays, etc. for interacting with a user. In other embodiments, control panel 26 may be separate from dispenser 24 (e.g., on a different door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Figure 2:
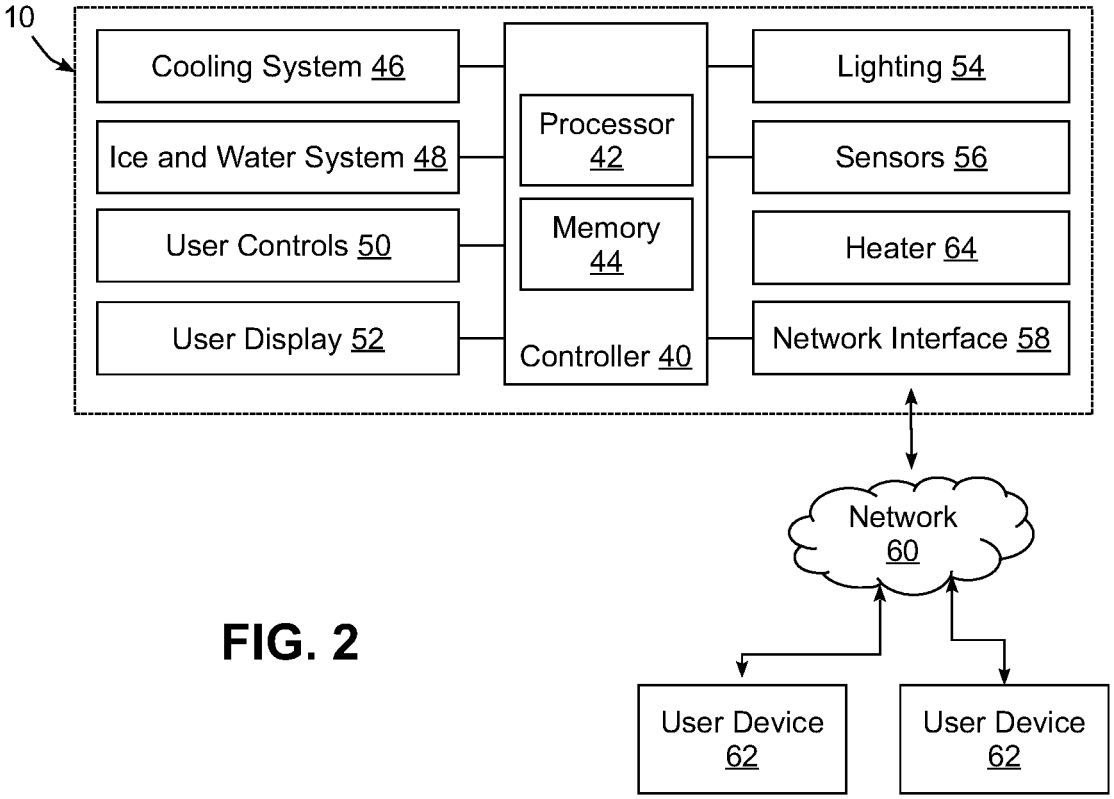
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. User controls and/or user displays 50, 52 may be disposed, for example, on one or more control panels disposed in the interior and/or on doors and/or other external surfaces of the refrigerator. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. For example, sensors may include temperature sensors within an icemaker, as well as temperature sensors within the fresh food and/or freezer compartments 14, 16. Sensors 56 may also include additional types of sensors such as door switches, switches that sense when a portion of an ice dispenser has been removed, and other status sensors. Controller 40 may also be interfaced with one or more heaters 64 of an ice making system as described herein.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Multi-Zone Ice Maker

In the embodiments discussed hereinafter, a refrigerator may include an ice maker with multiple zones, where the heating pattern and release of ice from each zone may be independently controlled. For example, such an ice maker, as will be described and illustrated herein, may include a mold body with multiple cups for forming ice. Each of these cups includes an opening to receive water to be frozen. The mold body may be divided into multiple zones, where each zone may contain a heater to heat the cups for removal of the ice. In some embodiments, the ice maker may also be in communication with a controller to harvest ice from each zone independently. For example, the first heater may provide heat to the first zone of the mold body to facilitate a release of ice from only the first zone, and thereafter harvesting ice from the second zone once the ice in the first zone is released from the first zone Release of the ice may occur when the surface of the ice in contact with the cup, tray, or other body begins melting such that the ice is movable relative to the cup, tray or other body to facilitate removal of the ice.

Figure 3:
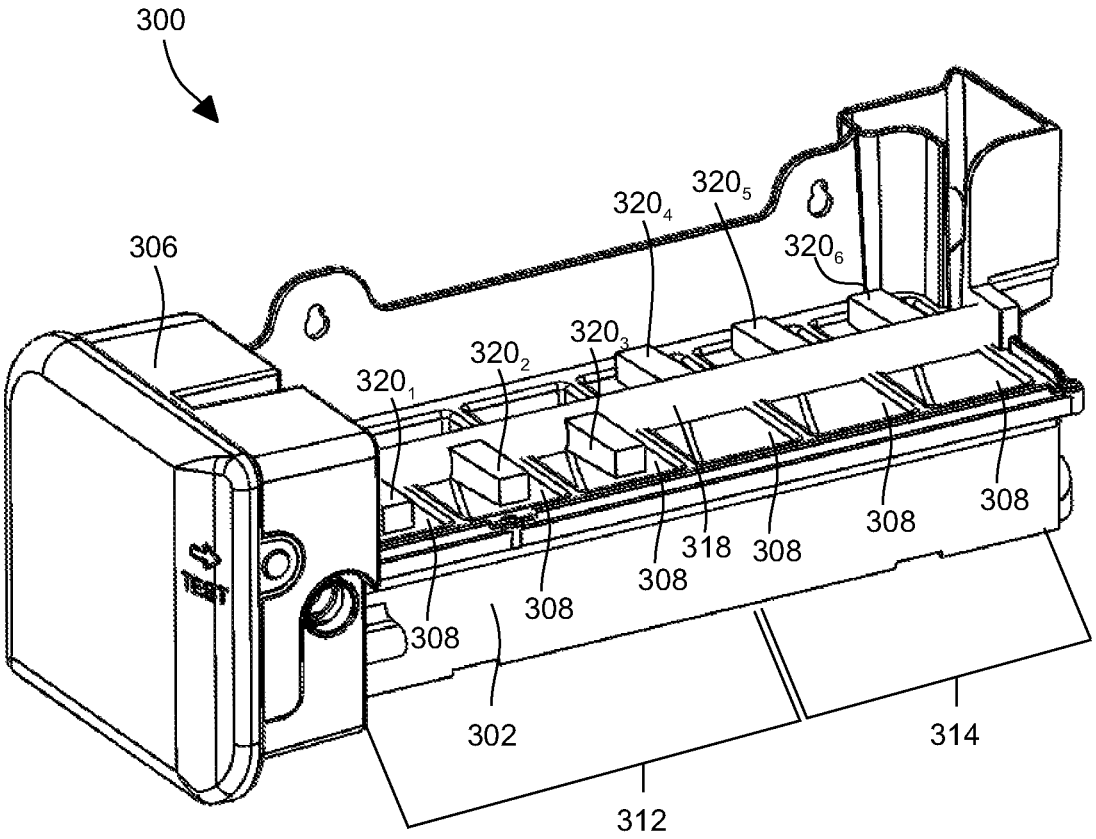
FIG. 3 is a perspective view of an exemplary multi-zone ice maker consistent with some embodiments of the invention.
Figure 4:
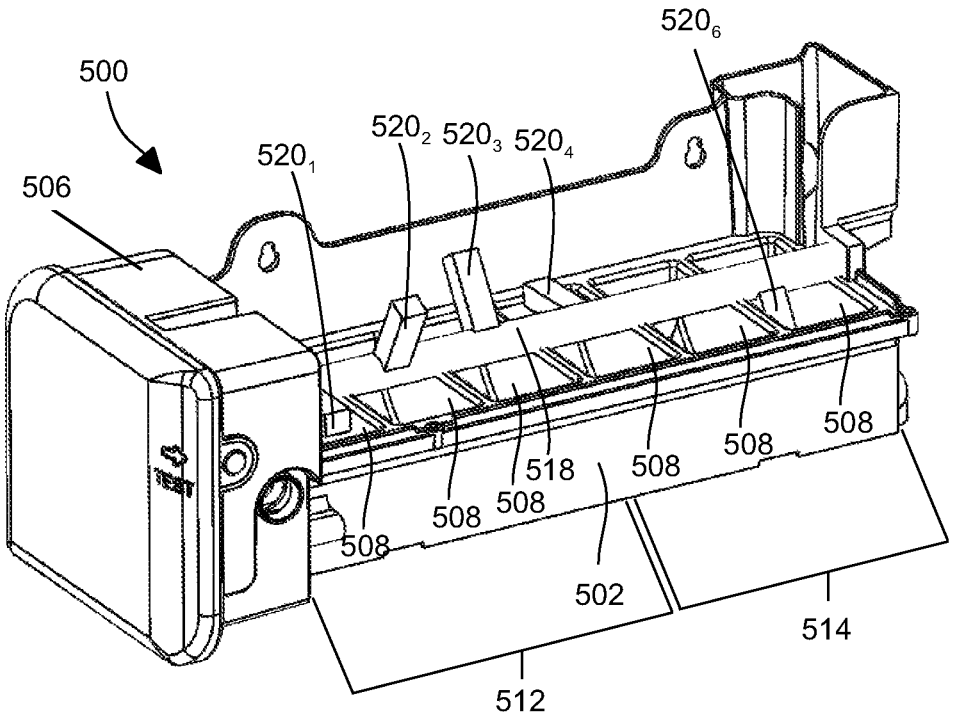
FIG. 4 is a perspective view of another exemplary multi-zone ice maker consistent with some embodiments of the invention.
Figure 5:
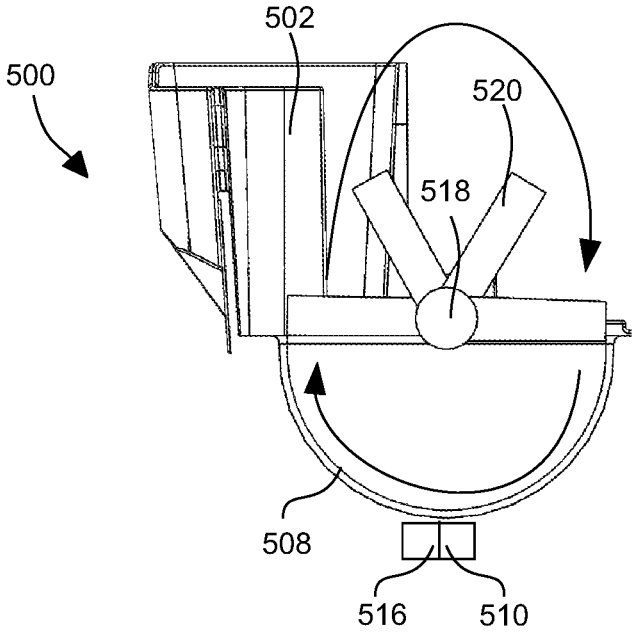
FIG. 5 is cross-sectional views of the exemplary multi-zone ice maker of FIG. 4 illustrating the rake in motion.

Now turning to FIG. 3, an exemplary ice maker 300 is illustrated. In some instances, such as illustrated, the ice maker 300 includes a mold body 302, which may further contain the cups 308 that form the ice. Disposed near each cup 308, may be a heater (not visible, see 510 in FIG. 5). In some instances, such as illustrated in FIG. 5, these heaters 510 may be disposed below the cups 508. The ice maker 300 also includes a motor 306 that is configured to drive a rake 318 for harvesting the ice, as will be described herein. In some instances, such as illustrated in FIG. 3, the cups 308 may be integrated into the mold body 302. In other instances, the cups 308 may be constructed separately from the mold body 302 (for example see FIG. 6). These cups 308 receive water and form the ice, and as such, resulting ice will reflect the shape of the cups 308. In some instances, these cups 308 may be formed, for example via stamping, of stainless steel, which may be desired for its corrosion resistance and longevity. In other instances, these cups 308 may be formed, for example, of another thermally conductive material, such as Copper. In such instances, the mold body 302 may be formed of an aluminum, and the cups may be stamped with the thermally conductive material. These materials are not intended to be limiting, as any material with a high thermal conductivity may be used. In still other embodiments, the mold body 302 may be constructed of a plastic material, and the cups 308 may be dipped or coated in a thermally conductive metal or a physical vapor deposition (PVD) coating. In typical ice makers, the majority of the mold body is utilized to house the heater, for example a calrod heater, and to conduct heat towards the cups. As illustrated in FIGS. 3 and 4, the thermally conductive material may only be the cups 308 or within the cups 308. This may, in some instances, allow for the ice maker 300 to have a smaller footprint within a refrigerator. Nonetheless, in other embodiments, a calrod heating system having multiple calrods for heating different zones may be used. Additionally, the ice maker 300 may be divided into separate zones. As a non-limiting example, ice maker 300 includes a first zone 312 and a second zone 314, where each zone includes three cups 308. The zones illustrated in FIG. 3 are not limiting, for example in some instances each cup 308 may be its own zone.

The ice maker 300 also includes a motor 306 that is configured to drive a rake 318. The rake 318 may further include a plurality of rake fingers $\mathbf{320}_{1\text{-}n}$ that are configured to make contact with the ice and provide rotational force to harvest the ice from the cups 308. In some instances, such as in the embodiment illustrated in FIG. 3, the plurality of rake fingers $\mathbf{320}_{1\text{-}3}$ in the first zone 312 are in a first position and the plurality of rake fingers $\mathbf{320}_{4\text{-}6}$ in the second zone 314 are in a second position, where the second position is directly opposed or 180 degrees from the rake fingers $\mathbf{320}_{1\text{-}3}$ in the first position. In other instances, such as illustrated in FIG. 4, each rake finger may be in a different position. The motor 306 may drive a full 360-degree rotation of the rake 318 and plurality of rake fingers $\mathbf{320}_{1\text{-}n}$. In some embodiments, this 360-degree rotation may be divided into two 180-degree rotations, each of which is then followed by a pause. In the staggered rake embodiment illustrated in FIG. 3, a first 180-degree rotation occurs, and then there is a pause before the remaining 180-degree rotation. Each of these 180-degree rotations may result in the harvest of ice from one zone 312, 314 of the mold body 302 at a time. This may result in independent control of the zones, such that one zone (e.g. one-half in the embodiment of FIG. 3) may be harvested, while the remaining zone continues to freeze, alternating back and forth.

In other instances, the motor may be reversible. In such instances, the motor may be configured to turn both clockwise and counterclockwise. An example of a reversible motor may be found in U.S. application Ser. No. 16/711,094, incorporated by reference. Turning the motor clockwise may engage a portion of the rake fingers, while turning the motor counterclockwise would engage another portion of the rake fingers. Such an embodiment may further include an internal shaft connected to the motor, and a ratchet-like system for each rake finger to ensure that each rake finger is only engageable in a single rotational direction. This may also allow pieces of ice in each of the zones of a mold body to be harvested individually based upon the direction of rotation of the motor.

Now turning to FIGS. 4 and 5, another embodiment of an ice maker 500 is illustrated. Similar to the ice maker described with reference to FIG. 3, ice maker 500 includes a mold body 502 with cups 508 that form the ice. Near each cup 508 may be a heater 510, similar to those described herein. The ice maker 500 also includes a motor 506 that is configured to drive a rake 518 for harvesting the ice. Differing from the ice maker described with reference to FIG. 3, the rake 518 of ice maker 500 has rake fingers $\mathbf{520}_{1\text{-}n}$ in a plurality of positions to allow for a staggered rake of a single piece of ice at a time. For example, as illustrated in FIG. 5, there are six cups for forming six pieces of ice, and each rake finger 520 may be positioned so that a one-sixth (or 60-degree) rotation of the rake 518 may result in the harvest of a single piece of ice. In such instances, each of the cups 508 may be independently filled with water, frozen, warmed by the heater, and released separately by the rake. However, this is not intended to be limiting, as in some instances the mold body 502 may have fewer than six cups for forming ice; while in other instances, the mold body 502 may have seven or more cups 508 for forming ice.

Figure 8:
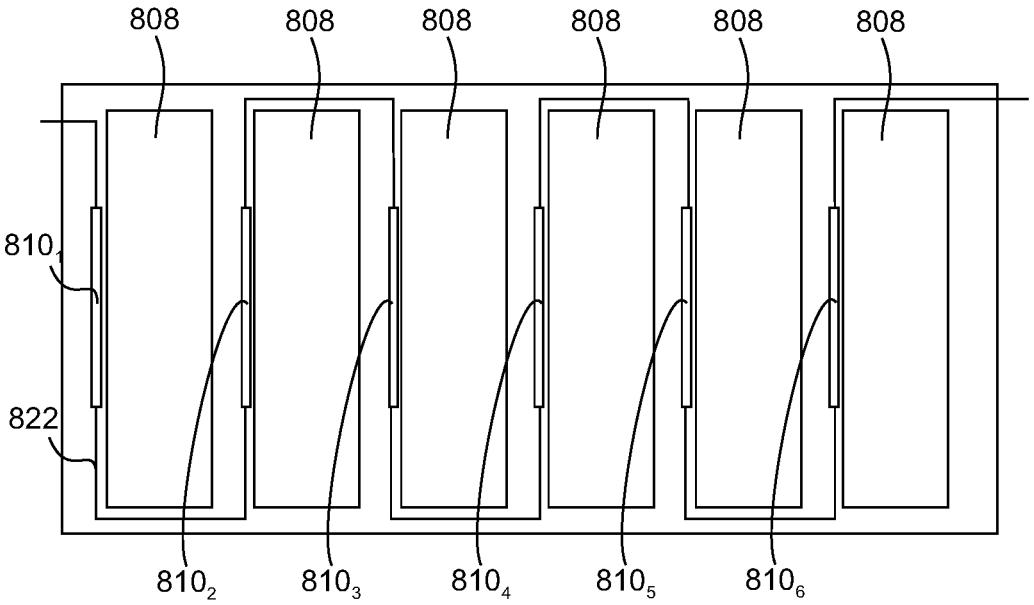
FIG. 8 is a top view of another exemplary mold body of an ice maker consistent with some embodiments of the invention.

As mentioned, near each cup 508 may be a heater 510, which may be utilized in order to melt a surface of the ice in contact with the cup 508 in preparation for harvesting the ice. In some instances, these heaters 508 may be flat printed circuit board (PCB) mounter heaters. In some instances, the heater itself may be a ceramic heater, but is not so limited. These heaters 508 may be disposed adjacent to the cups 508. In some instances, the heaters 510 may be disposed underneath the cups 508 or the heaters 510 may be in direct contact with the cups 508. In other instances, the heaters 510 may be disposed between the cups 508, for example as illustrated in FIG. 8. These heaters 510 may be interfaced with a controller (for example controller 40 of FIG. 2), which may allow for independent control of each heater 510. Independent control of these heaters 510 may allow for varying heating patterns where some of the heaters 510 may be energized (and thus producing heat) while others are not. Furthermore, this allows for the ice maker 500 to be divided into separate zones, for example a first zone 312 and a second zone 314, where each zone includes three cups 308. Independent control of the heaters 510 and/or zones 512, 514 may facilitate harvest of subsets of ice from the mold body 502, as opposed to harvesting ice from all of the cups 308 simultaneously. This zoned harvesting of ice may, in some instances, reduce the noise generated by the ice maker 500, and may reduce the torque requirement for motor 506. FIG. 5 illustrates a single one fill cup or plastic attachment at the end of the ice maker 500. This fill cup directs the water into the cups 508. Where each zone is independently filled, there may be at least one fill cup per zone 512, 514.

Also adjacent one or more of the cups 508 may be an associated temperature sensor 516, which may also be interfaced with a controller (for example controller 40 of FIG. 2). In some instances, each cup 508 may have a corresponding temperature sensor 516. In other instances, there may be a single temperature sensor 516 per zone 512, 514 of the mold body 502. As will be described in greater detail herein, the controller may utilize feedback (e.g. a signal) from the temperature sensor 516 when determining a time to harvest to ice from the cups 508. For example, because of the phase change from solidified ice to liquid water at a precise temperature of about 0 degrees Celsius, the controller may be able to determine, based on the temperature sensor 516, when a thin layer of water has formed at the surface of the cup 308, indicating that the ice may be ready to harvest. Similarly, the controller may also be able to determine, based on the temperature sensor 516, the phase change from liquid water to solidified ice.

Figure 6:
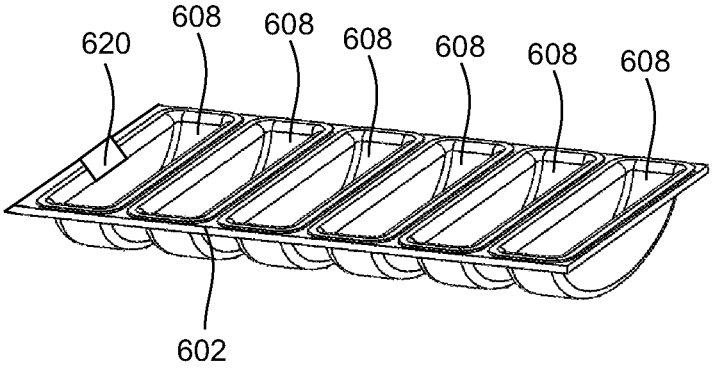
FIG. 6 is a perspective view of an exemplary mold body of an ice maker consistent with some embodiments of the invention.

Now turning to FIG. 6, another embodiment of the cups 608 for forming ice is illustrated. In such an embodiment, the cups 608 may be individually formed of a thermally conductive material (e.g. stainless steel, copper, or the like) and placed into a tray 602 that may, in some instances, be constructed of a plastic. In such instances, this tray 602 is the mold body. Such a construction may allow the cups 608 to be individually replaced, which may, for example, be desirable for servicing. In some instances, the cups 608 may be replaced along with a rake (not illustrated in FIG. 6). Replacing both the cups 608 and rake, while utilizing the same motor, may allow a user to select between varying sizes, shapes, etc. of ice based on their individual preference. For example, a user may be able to select between different configurations of size, shape, and/or number of pieces of ice. For example, in some instances, a user may be able to choose between a six, seven, eight, or nine cup (or ice) tray configuration, where the larger the number of pieces of ice generated, the smaller each piece is. In other instances, the cups of each zone may have differing shapes, such that each cup of the first zone of the mold body is a first shape and each cup of the second zone of the mold body is a second, different shape.

Also illustrated in FIG. 6, is an overhang 620 from the tray 602 over a cup 608, and may allow for water distribution to each cup 608 from a single water source. This overhang 620 may allow for water to move from the tray 602 into each of the cups 608 with minimal dripping. In some instances, this overhang 620 may be present on every cup 608, for individual filling of cups as needed.

Figure 7:
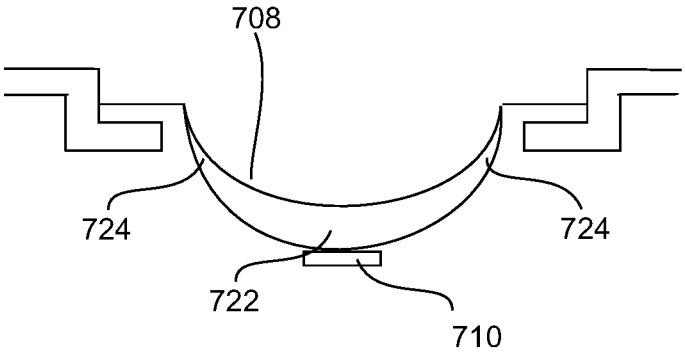
FIG. 7 is a cross-sectional view of another exemplary multi-zone ice maker consistent with some embodiments of the invention.

In some instances, it may be desirable to improve the evenness of the heating of the cups. Therefore, in some instances, such as illustrated in FIG. 7, the cup(s) 708 may have a non-uniform thickness. In such instances, a portion 722 of the cup 708 disposed nearest to the heater 710 may be thicker than the remainder of the cup 708. In other instances, there may be some other nonuniform thickness profile as needed for optimal and even heating. In the illustrated embodiment, this portion 722 is the bottom, or lowest portion of the cup 708, but this is not so limited. In some embodiments, such as illustrated in FIG. 7, the heater may be located between the cups, and in such instances, the portion nearest the heater would be the thickest. When heat is applied via the heater 710, it is conducted through the cup 708 due to the cup's construction of one or more thermally conductive materials. When heat is added at the thickest portion 722 of the cup 708 the heat then is conducted through the thickest portion 722 to the edge portions 724 of the cup, which are thinner. This pattern of conduction may allow the heater 710 to maintain the cup 708 at a more consistent temperature across its bottom surface.

As mentioned, the heaters discussed herein are not limited to being disposed underneath the cups, in some instances, such as illustrated in FIG. 8, the heaters $\mathbf{810}_{1\text{-}n}$ may also be disposed between the cups 808. In such instances, the heaters $\mathbf{810}_{1\text{-}n}$, which may in some instances be printed circuit board (PCB) heaters (as discussed with reference to FIGS. 3 and 4), may be positioned as a series of heaters $\mathbf{810}_{1\text{-}n}$ connected by wire 822. Use of wire 822 may allow the heaters $\mathbf{810}_{1\text{-}n}$ to be positioned in any direction, including where turns along corners may be required. Such positioning could be used in U-shaped ice makers, L-shaped ice makers, or the like, which may allow for optimization of space within the refrigerator. Such positioning may also be used to simply optimize the heat distribution to the cups 808.

Figure 9:
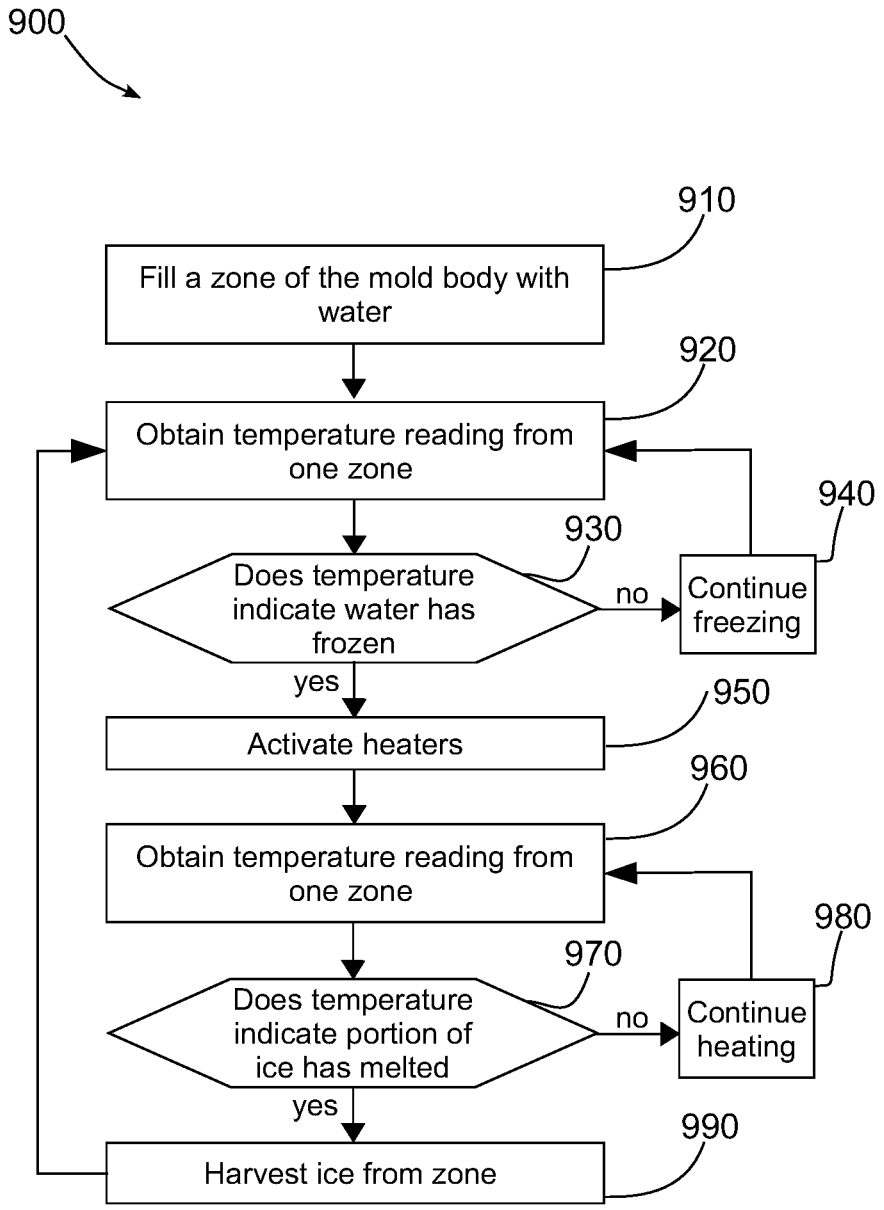
FIG. 9 is an example embodiment of an operational flow of an icemaker consistent with some embodiments of the invention.

Turning now to FIG. 9, an example embodiment of an operational flow 900 of an icemaker is illustrated. In block 910, at least one zone of the ice maker is filled with water. In block 920, a temperature sensor obtains a temperature reading from a cup or a zone of the mold body. The temperature sensor may then send a signal regarding that reading to the controller, which receives this signal. The controller then determines, in block 930 based on this temperature reading, whether the temperature at the cup or the zone of the mold body is within a predefined range indicating that the water disposed within the cup or cups of the zone of the mold body are frozen. For example this may be any temperature below about 0 degrees Celsius. If the controller determines, in block 930, based on the signal from the temperature sensor, the temperature at the cup or the zone of the mold body is not within the predefined range the water is allowed to continue to freeze, in block 940. After a predetermined amount of time has passed, the temperature sensor again obtains a temperature reading from a cup or a zone of the mold body, block 920. The temperature sensor may then send a signal regarding that reading to the controller, which receives this signal. The controller then again determines, in block 930 based on this temperature reading, whether the temperature at the cup or the zone of the mold body is within a predefined range indicating that the water disposed within the cup or cups of the zone of the mold body are frozen. When the controller determines, in block 950, based on the signal from the temperature sensor, the temperature at the cup or the zone of the mold body is within the predefined range the heater is activated by the controller.

After the activation of the heater, in block 960, the temperature sensor takes another temperature reading, and the controller determines, in block 970, if the temperature is indicative of the ice being partially melted and ready for harvesting. For example, in some instances, this may be determined by examining if this second temperature reading is within a predefined temperature range. An exemplary temperature range indicating the ice may be partially melted and ready to harvest may be above about 0 degrees Celsius. If the controller determines, based on this second signal from the temperature sensor, the temperature at the cup or in the zone is not within the predefined range the heater may remain on and continue to heat the ice, block 980. After a predetermined amount of time has passed, the temperature sensor again obtains a temperature reading from a cup or a zone of the mold body, block 960. The controller again determines if the temperature is indicative of the ice being partially melted and ready for harvesting, block 970. When the controller determines, based on the second signal from the temperature sensor, the temperature at the cup or the zone of the mold body is within the predefined range the ice is harvested, block 990, utilizing the rake and rake fingers described herein. The process is then repeated with the next zone of the ice maker.

Figure 10:
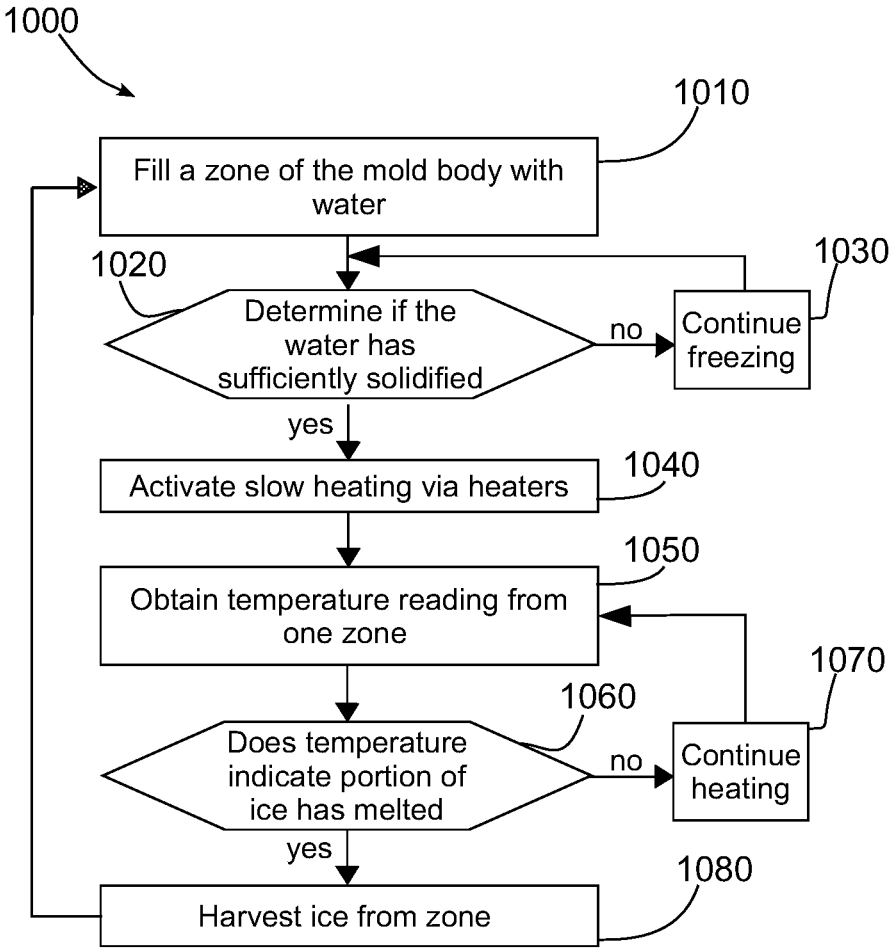
FIG. 10 is another example embodiment of an operational flow of an icemaker consistent with some embodiments of the invention.

Turning now to FIG. 10, example embodiment of a slow release operational flow 1000 of an icemaker is illustrated. In such instances, a heater may actuate before the ice is completely frozen. For example, the heater may be used to melt the surfaces of the ice in contact with the cup to facilitate release of the ice, while the ice is still simultaneous freezing. Similar to the operational flow of FIG. 9, in block 1010, at least one zone of the ice maker is filled with water. The controller may then, in block 1020 determine if the ice has met a pre-determined level of frozenness, or has solidified enough. In some instances, the controller may make this determination based on the passage of a pre-determined period of time. In other instances, the controller may make this determination based on one or more readings from a temperature sensor. If the controller determines the water has not sufficiently solidified, the water is allowed to continue to freeze, block 1030. The controller will continue to utilize the information described previously to determine if the water has sufficiently solidified, block 1020. When the controller determines that the water is sufficiently solidified the heater is activated by the controller, block 1040, to heat the ice slowly. In some instances, the heater may heat the cups to just above freezing (e.g. 0-10 degrees Celsius) for a period of time, for example about ten minutes 10 minutes. This may allow for the portion of the ice nearest the heater to begin melting to melt a surface of the ice in contact with the cup to prepare for harvesting, while the portion of the ice farthest away from the heater is still solidifying.

After the activation of the heater, a temperature sensor may take a temperature reading, block 1050, and the controller determines if the temperature is indicative of the ice being partially melted and ready for harvesting, block 1060. For example, in some instances, this may be determined by examining if this second temperature reading is within a predefined temperature range. An exemplary temperature range indicating the ice may be partially melted and ready to harvest may be between about 0 to about 5 degrees Celsius. If the controller determines, based on the signal from the temperature sensor, the temperature at the cup or in the zone is not within the predefined range the heater may remain on and continue to heat the ice, block 1070. After a predetermined amount of time has passed, the temperature sensor again obtains a temperature reading from a cup or a zone of the mold body, block 1050. The controller again determines if the temperature is indicative of the ice being partially melted and ready for harvesting, block 1060. When the controller determines, based on the signal from the temperature sensor, the temperature at the cup or the zone of the mold body is within the predefined range the ice is harvested, block 1080, utilizing the rake and rake fingers described herein. The process is then repeated with the next zone of the ice maker, returning to block 1010.

Use of slow heating, such as described with reference to FIG. 10, may result in less dripping form the heating used to preparing the ice for harvesting. Slow heating may also decrease the time required for preparation of the next cycle of ice, as the cups do not have to cool down considerably.

Other variations will be apparent by those of ordinary skill having the benefit of the instant disclosure. It will be appreciated that various additional modifications may be made to the embodiments discussed herein, and that a number of the concepts disclosed herein may be used in combination with one another or may be used separately. Therefore, the invention lies in the claims hereinafter appended.

What is claimed is:

1. A refrigerator, comprising:

a cabinet including one or more food compartments and one or more doors closing the one or more food compartments;

an ice maker disposed in the cabinet to produce ice, the ice maker including:

a mold body for forming ice, the mold body including a plurality of simultaneously upright cups, each upright cup having an opening for receiving water to be frozen within the upright cup, wherein the mold body is divided into at least a first zone including at least one upright cup from the plurality of simultaneously upright cups and a second zone including at least one upright cup from the plurality of simultaneously upright cups;

at least a first heater and a second heater configured to provide heat to the first and second zones of the mold body and thereby facilitate a release of ice from the first and second zones of the mold body, respectively; and a controller coupled to the ice maker and configured to:

harvest ice from the first zone independently of the second zone by actuating the first heater to provide heat to the first zone of the mold body to facilitate the release of ice from the first zone and thereafter harvesting ice from the second zone once the ice in the first zone is released from the first zone;

harvest ice from the second zone independently of the first zone by actuating the second heater to provide heat to the second zone of the mold body to facilitate the release of ice from the second zone and thereafter harvesting ice from the first zone once the ice in the second zone is released from the second zone.

2. The refrigerator of claim 1, wherein each upright cup of the plurality of simultaneously upright cups is constructed of metal and the mold body is constructed of plastic.

3. The refrigerator of claim 1, wherein each upright cup of the plurality of simultaneously upright cups is constructed of a plastic material with a metallic coating.

4. The refrigerator of claim 1, wherein each upright cup of the plurality of simultaneously upright cups is individually removable from the mold body.

5. The refrigerator of claim 1, wherein the first and second zones are among a plurality of zones and the first and second heaters are among a plurality of heaters, and wherein each upright cup of the plurality of simultaneously upright cups defines a zone among the plurality of zones and has an associated heater among the plurality of heaters.

6. The refrigerator of claim 5, wherein the controller is further configured to independently control each heater among the plurality of heaters.

7. The refrigerator of claim 5, wherein each upright cup of the plurality of simultaneously upright cups has a non-uniform thickness.

8. The refrigerator of claim 7, wherein each upright cup of the plurality of simultaneously upright cups is thickest at a portion proximate the corresponding heater among the plurality of heaters.

9. The refrigerator of claim 1, wherein the first and second zones of the mold body further include a first temperature sensor and a second temperature sensor, respectively.

10. The refrigerator of claim 9, wherein the controller is further configured to:

receive a first and second signal from the first and second temperature sensors, respectively;

determine, based on the first signal and second signal, that one of the first or second zone is within a predefined temperature range; and when the determined one of the first or second zone is within the predefined temperature range, actuate the first heater or the second heater to begin heating each upright cup of the plurality of simultaneously upright cups within the first or second zone of the mold body.

11. The refrigerator of claim 1, wherein the controller is further configured to stagger the release of ice, wherein only the first zone of the mold body or the second zone of the mold body is harvested, while the other of the first zone of the mold body or the second zone of the mold body remains unharvested.

12. The refrigerator of claim 11, wherein the ice maker further comprises:

a reversible motor to harvest ice;

a plurality of rake fingers, wherein-a first portion of the plurality of rake fingers rotate in a clockwise direction and a second portion of the plurality of rake fingers rotate in a counter-clockwise direction; and wherein the reversible motor drives the clockwise rotation of the first portion of the plurality of rake fingers to harvest the first zone of the mold body; and wherein the reversible motor drives the counter-clockwise rotation of the second portion of the plurality of rake fingers to harvest the second zone of the mold body.

13. The refrigerator of claim 1, wherein the ice maker further comprises:

a motor to harvest ice;

a plurality of rake fingers, including:

a first portion of the plurality of rake fingers disposed in the first zone and in a first position; and a second portion of the plurality of rake fingers disposed in the second zone and in a second, differing position.

14. The refrigerator of claim 13, wherein the first position and the second, differing position are directly opposed to each other.

15. The refrigerator of claim 1, wherein the ice maker further comprises:

a motor to harvest ice;

a plurality of rake fingers, wherein each rake finger of the plurality of rake fingers is in a different position to allow for a staggered rake of a single piece of ice at a time.

16. The refrigerator of claim 1, wherein each upright cup among the plurality of simultaneously upright cups disposed in the first zone of the mold body is a first shape, and each upright cup among the plurality of simultaneously upright cups disposed in the second zone of the mold body is a second, different shape.

17. The refrigerator of claim 1, wherein the first heater and the second heater are ceramic heaters.

18. The refrigerator of claim 1, wherein the controller is further configured to:

determine that one of the ice in the first or second zone is at a predefined level of solidity; and when the determined one of the first or second zone is within a predefined temperature range, actuate the first heater or the second heater to begin heating each upright cup of the plurality of simultaneously upright cups within the first or second zone of the mold body prior to the ice being completely solid.

19. The refrigerator of claim 1, wherein:

each upright cup of the plurality of simultaneously upright cups is individually removable from the mold body and has a non-uniform thickness;

at least one of the first and second heaters is disposed between a pair of upright cups of the plurality of simultaneously upright cups;

the ice maker further comprises a reversible motor to harvest ice and a plurality of rake fingers; and each rake finger of the plurality of rake fingers is in a different position to allow for a staggered rake of a single piece of ice at a time.

20. An ice maker, comprising:

a mold body for forming ice, the mold body including a plurality of simultaneously upright cups, each upright cup having an opening for receiving water to be frozen within the upright cup, wherein the mold body is divided into at least a first zone including at least one upright cup from the plurality of simultaneously upright cups and a second zone including at least one upright cup from the plurality of simultaneously upright cups;

at least a first heater and a second heater configured to provide heat to the first and second zones of the mold body and thereby facilitate a release of ice from the first and second zones of the mold body, respectively;

a controller coupled to the ice maker and configured to harvest ice from the first zone independently of the second zone by actuating the first heater to provide heat to the first zone of the mold body to facilitate the release of ice from the first zone and thereafter harvesting ice from the second zone once the ice in the first zone is released from the first zone;

harvest ice from the second zone independently of the first zone by actuating the second heater to provide heat to the second zone of the mold body to facilitate the release of ice from the second zone and thereafter harvesting ice from the first zone once the ice in the second zone is released from the second zone.

* * * * *